US005576728A

United States Patent [19]

Maeda

[11] Patent Number: 5,576,728

[45] Date of Patent: Nov. 19, 1996

[54] DRIVING METHOD FOR AN ELECTROOPTICAL DEVICE

[75] Inventor: Takeshi Maeda, Tokyo, Japan

[73] Assignee: Seiko Instruments Inc., Japan

[21] Appl. No.: 132,684

[22] Filed: Oct. 6, 1993

Related U.S. Application Data

[63] Continuation of Ser. No. 755,490, Sep. 5, 1991, abandoned.

[30] Foreign Application Priority Data

Sep. 13, 1990 [JP] Japan ..... 2-245073

[51] Int. Cl.[6] ..... G09G 3/36

[52] U.S. Cl. ..... 345/91; 345/96; 345/210; 345/209

[58] Field of Search ..... 345/94, 91, 95, 345/96, 208, 209, 210

[56] References Cited

U.S. PATENT DOCUMENTS

| | | | |
|---|---|---|---|
| 4,728,175 | 3/1988 | Baron | 359/60 |
| 4,731,610 | 3/1988 | Baron et al. | 340/784 |
| 4,828,370 | 5/1989 | Suzuki | 359/57 |
| 4,842,372 | 6/1989 | Toyama | 359/58 |
| 4,868,616 | 9/1989 | Johnson et al. | 357/17 |
| 4,871,234 | 10/1989 | Suzuki | 359/58 |
| 4,961,630 | 10/1990 | Baron et al. | 359/54 |
| 4,983,022 | 1/1991 | Shannon | 359/60 |
| 4,994,796 | 2/1991 | Kuijk | 340/784 |

FOREIGN PATENT DOCUMENTS

| | | |
|---|---|---|
| 0233489 | 8/1987 | European Pat. Off. . |
| 0434627 | 6/1991 | European Pat. Off. . |
| 0447077 | 9/1991 | European Pat. Off. . |
| 2217891 | 11/1989 | United Kingdom . |

*Primary Examiner*—Tommy P. Chin
*Assistant Examiner*—A. Au
*Attorney, Agent, or Firm*—Adams & Wilks

[57] ABSTRACT

A driving method for an electooptical device is disclosed. A plurality of nonlinear resistance elements are arranged in units of pixel electrodes, and two adjacent operating electrodes are coupled through independent nonlinear resistance elements which are controlled by the pair of operating electrodes so as to provide a stable operation against variation in characteristics of the nonlinear resistance elements and to prevent deterioration of display over time. Data signals are applied to signal electrodes and are set in reference to nonselected scan signals applied to the scan electrodes during a nonselected period. Thus, the data input to one pixel is not affected by data input to the other pixels and is not affected during the period between a first frame scanning and a next frame scanning.

8 Claims, 4 Drawing Sheets

DRIVING METHOD FOR AN ELECTROOPTICAL DEVICE

This is a continuation of application Ser. No. 755,490 filed Sep. 5, 1991 now abandoned.

BACKGROUND OF THE INVENTION

This invention relates to a driving method of an electrooptic device including pixel electrodes and nonlinear resistance elements arranged as to define pixels along driving electrodes.

Among the various display panels known in the art, the liquid crystal type display panel is excellent because it can be thin in thickness, light in weight, and low in power consumption. Thus, the liquid crystal display panel is widely used in computers of the lap-top type, note book type, and the like. In particular, the active matrix type display panel is attractive because it is capable of handling a large volume of display information and attaining a high degree of picture quality. The active matrix display panel use the three-terminal type active element which is a thin-film transistor, and the two-terminal type active element which is a nonlinear resistance element such as MIM or a PN junction thin-film diode.

The three-terminal element needs a number of film formed. Thus, its manufacturing process is complicated, yield is low, and cost is high. The diode has a characteristic of low operation voltage and weak resistance to static electricity. Contrarily, the nonlinear resistance element is simple in structure and can be operated at high voltage, thus can be advantageously used in large-size display panels without increasing cost.

The conventional electrooptical device using nonlinear resistance elements has a structure such that an electrooptical liquid crystal material is sealed between two opposing substrates on which column and row electrodes are formed respectively, and nonlinear resistance elements and pixel electrodes are formed on the inner surface of one of the substrates. The nonlinear resistance element is connected between the pixel electrode and the row or column electrode. This type of electrooptical device is disclosed in U.S. Pat. No. 4,871,234.

In order to display on this liquid crystal panel, it is important to determine a driving voltage and, the correct composition and thickness of the nonlinear resistance layer so as to obtain desired resistances of nonlinear resistance element during driving with an applied voltage. It is also important to increase a ratio of a capacitance of a liquid crystal portion of each unit pixel to a capacitance of a nonlinear resistance element portion so as to obtain a sufficient operating margin and to compensate for a distribution of element characteristics and deviations over time. In recent years, as the display panel using nonlinear resistance elements has become large, a problem develops during gray scale display.

In the nonlinear resistance element, however, a very small current (up to about 10 pA) flows even during the retention period. Stored data is affected gradually by data signals applied to a corresponding column electrode. For this reason, the RMS voltage applied to the liquid crystal in accordance with a display pattern gradually deviates from the predetermined value. In addition, since the resistance of the element greatly influences a charge injection capacity and a charge retention capacity, element characteristics vary within the panel surface and are shifted due to the deteriorations over time. At this time, changes in element characteristics cause a direct change in the RMS voltage applied to the liquid crystal. For this reason, when an RMS voltage applied to the liquid crystal is to be controlled with high precision as in a multilevel gray scale display, a contrast difference is caused to make it difficult to perform a normal display. This difference is increased when the panel size is increased and the number of dots is increased, resulting in difficulty and inconvenience.

SUMMARY OF THE INVENTION

It is an object of the present invention to solve the conventional problems described above.

An object of the present invention is to provide an electro-optical device wherein a plurality of nonlinear resistance elements are arranged in units of pixel electrodes, two adjacent operating electrodes are connected through independent nonlinear resistance elements, a resistance of the nonlinear resistance element is controlled by using the pair of operating electrodes to provide a stable operation against variations in characteristics of the nonlinear resistance element and deteriorations over time, and data input to one pixel is not adversely affected by data input to other pixels.

It is another object of present invention to provide a driving method of an electrooptic device which causes no differences in holding characteristic and keeps the contrast of a screen uniform even upon inversion of a driving waveform.

It is still another object of the present invention to improve a data write capacity and provide uniform display characteristics even if a distribution or deteriorations over time occur in element characteristics.

It is still another object of the present invention to stabilize a potential level of a pixel electrode during a selected period and facilitate control by a data signal, thereby accurately displaying gray scale levels.

The above and other objects, features, and advantages of the present invention will be apparent from the following detailed description and the claims in conjunction with the accompanying drawings.

BRIEF DESCRIPTION OF THE DRAWINGS

FIG. 1(*a*) shows the waveform of a scanning signal applied a first driving electrode;

FIG. 1(*b*) shows the waveform of a scanning signal applied to a second driving electrode;

FIG. 1(*c*) shows the waveform of a data signal applied to an opposing electrode when all pixels of one column are to be ON;

FIG. 1(*d*) shows the waveform of a data signal applied to the opposing electrode when all pixels of one column are to be OFF;

FIG. 1(*e*) shows the waveform of a data signal applied to the opposing electrode when all pixels but one of one column are to be OFF;

FIG. 1(*f*) shows the waveform of a data signal applied to the opposing electrode when all pixels but one of one column are to be ON;

FIG. 2(*a*) shows the waveform of a scanning signal applied to the first driving electrode;

FIG. 2(*b*) shows the waveform of a scanning signal applied to the second driving electrode;

FIG. 2(*c*) shows the waveform of a data signal applied to the opposing electrode when all pixels of one column are to be ON;

FIG. 2(*d*) shows the waveform of a data signal applied to the opposing electrode when all pixels of one column are to be OFF;

FIG. 2(*e*) shows the waveform of a data signal applied to the opposing electrode when all pixels but one of one column are to be OFF;

FIG. 2(*f*) shows the waveform of a data signal applied to the opposing electrode when all pixels but one of one column are to be ON;

FIG. 4(*a*) shows the waveform of a scanning signal applied to the first driving electrode;

FIG. 4(*b*) shows the waveform of a scanning signal applied to the second driving electrode;

FIG. 4(*c*) shows the waveform of a data signal applied to the opposing electrode when all pixels of one column are to be ON;

FIG. 4(*d*) shows the waveform of a data signal applied to the opposing electrode when all pixels of one column are to be OFF;

FIG. 4(*e*) shows the waveform of a data signal applied to the opposing electrode when all pixels but one of one column are to be OFF;

FIG. 4(*f*) shows the waveform of a data signal applied to the opposing electrode when all pixels but one of one column are to be ON.

DETAILED DESCRIPTION OF THE INVENTION

Figure 1A:
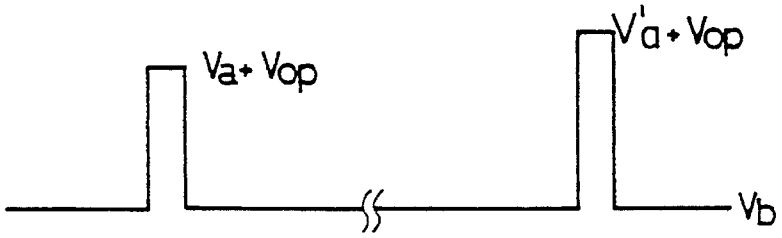
FIG. 1 is a diagram showing driving waveforms used to describe a first embodiment of the present invention.
Figure 1B:
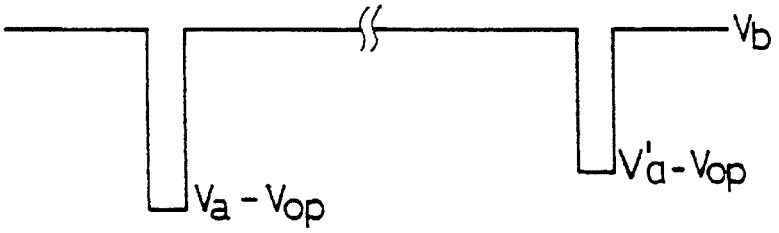
Figure 1C:
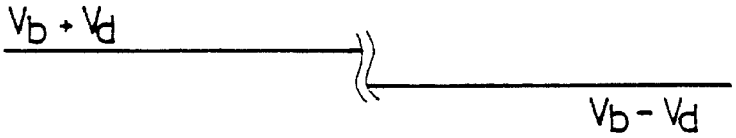
Figure 1D:
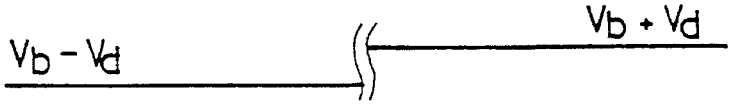
Figure 1E:
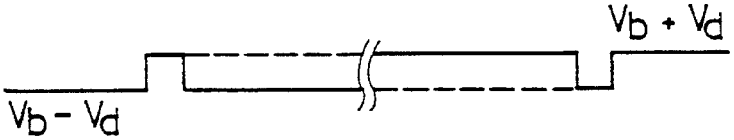
Figure 1F:
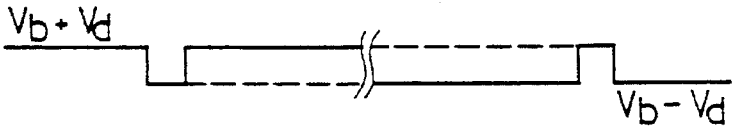
Figure 2A:
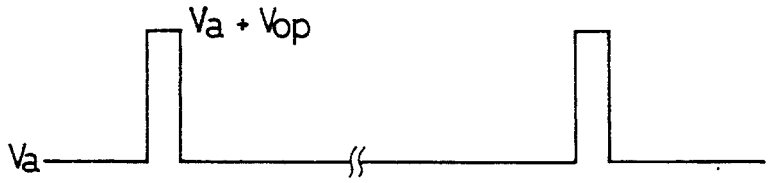
FIG. 2 is a diagram showing the driving waveforms of electrooptic device.
Figure 2B:
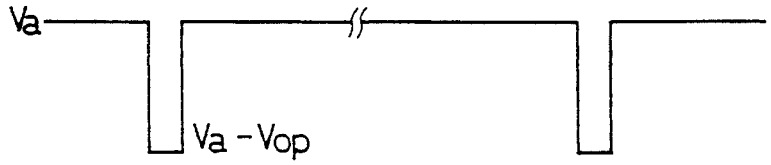
Figure 2C:
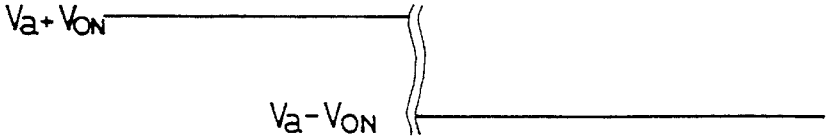
Figure 2D:
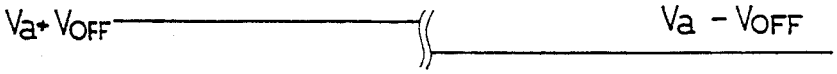
Figure 2E:
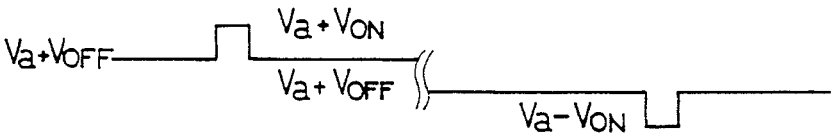
Figure 2F:
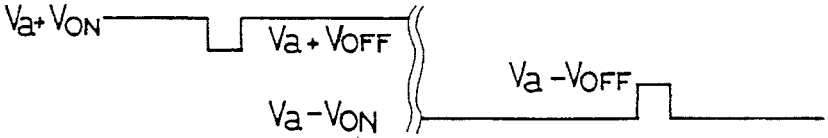
Figure 3A:
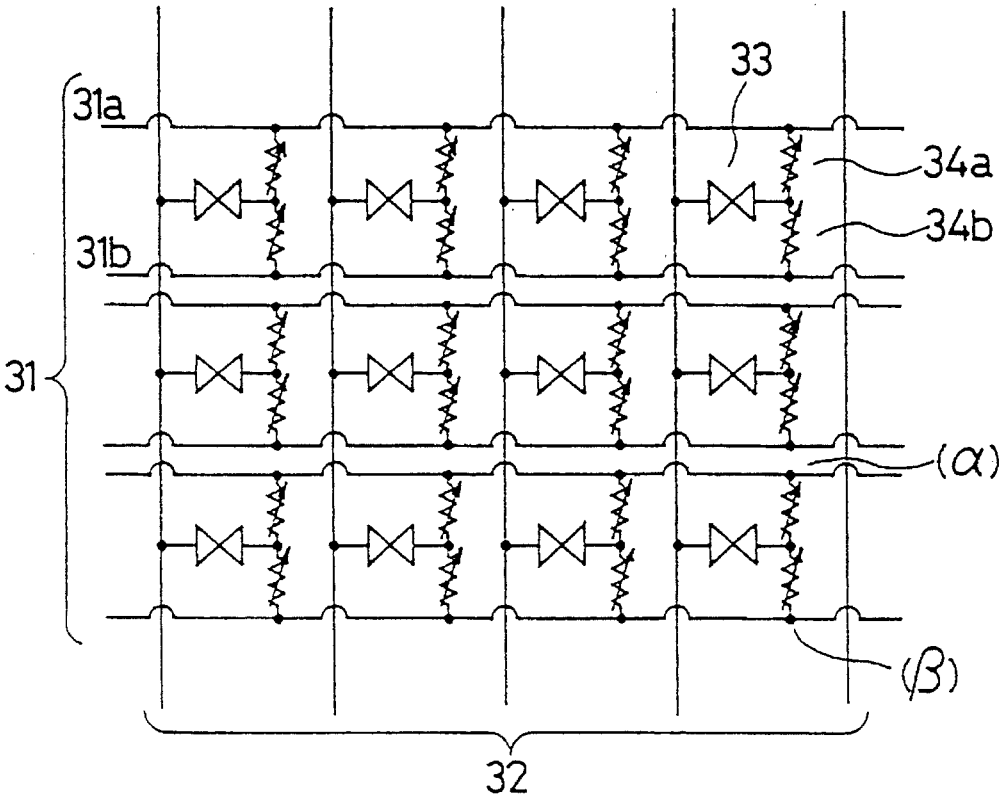
FIG. 3A is a circuit diagram of an electrooptic device including nonlinear resistance elements which is made in the form of an X–Y matrix panel.
Figure 3B:
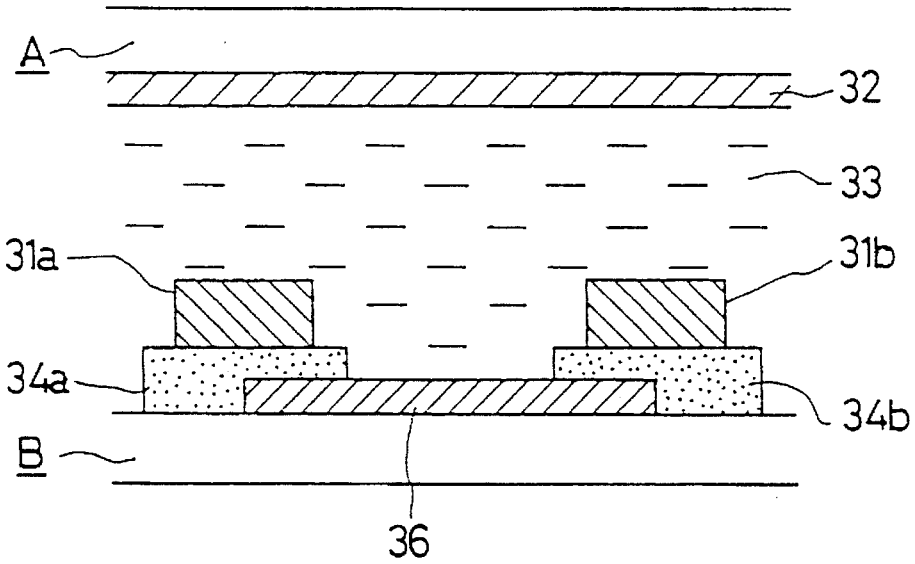
FIG. 3B is a sectional view of the electrooptic device including nonlinear resistance elements.
Figure 4A:
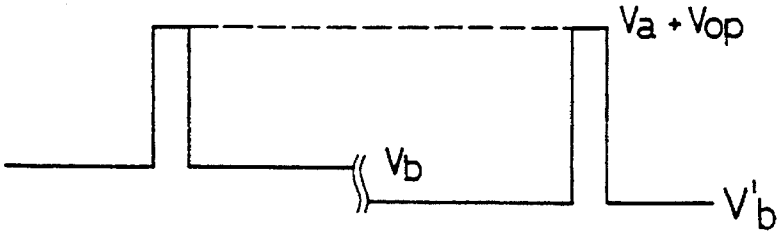
FIG. 4 is a diagram showing driving waveforms used to describe a second embodiment of the present invention.
Figure 4B:
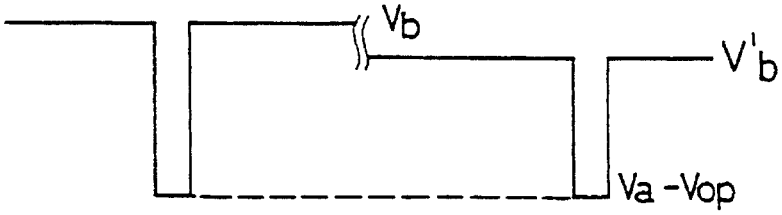
Figure 4C:
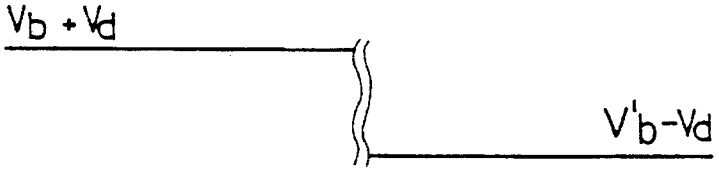
Figure 4D:
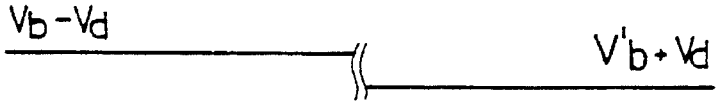
Figure 4E:
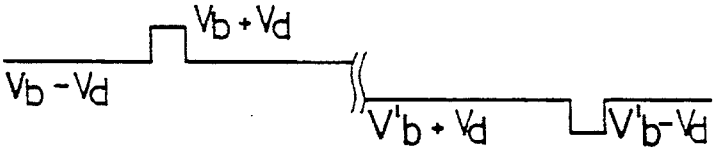
Figure 4F:
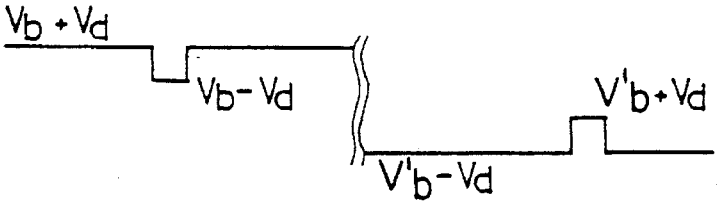

FIG. 3A is a circuit diagram of an electrooptic device including nonlinear resistance elements which is made in the form of an X-Y matrix panel, and FIG. 3B is a fragmentary sectional view of the electrooptic device. The number of row electrodes (scan electrodes) 31 and of column electrodes (signal electrodes) 32 formed on a substrate B and on an opposing substrate A is normally on the order of 100 to 1000. Each X-Y crossing area has a pixel electrode 36 and a plurality of nonlinear resistance elements 34*a* and 34*b* associated therewith which are separately connected to two scan electrodes 31*a* and 31*b*. An electrooptic material 33 is retained between the substrates A and B.

This type of display panel is driven as follows. That is, in FIG. 3*a* and FIG. 3B a number of pairs of scan electrodes 31*a* and 31*b* are serially selected from the top one after another, and during each selection period, data is imposed or charged by the signal electrode 32. FIG. 2 shows driving waveforms used in a electrooptic device, specifically, FIG. 2(*a*) shows the waveform of a scanning signal applied to the first scan electrode 31*a*, FIG. 2(*b*) shows the waveform of a scanning signal applied to the second scan electrode 31*b*, and FIGS. 2(*c*), (*d*), (*e*) and (*f*) show the waveform of data signals applied to the signal electrode 32. In FIG. 2(*a*), the potential of the first scan electrode 31*a* is kept at $V_a$ during the nonselection period and rises to $V_A+V_{op}$ during the selection period. In FIG. 2(*b*), the potential of the second scan electrode 31*b* is kept at $V_a$ during the nonselection period and changes to $V_A-V_{op}$ during the selection period.

Therefore, the voltage applied between the respective ends (points (α) and (β) in FIG. 3A) of the paired nonlinear resistance elements 34*a* and 34*b* is 0 (zero) during the nonselection period and $2V_{op}$ during the selection period. When the voltage value $V_{op}$ is set at a sufficiently large value, the nonlinear resistance elements 34*a* and 34*b* have low electrical resistivity, so that the potential level of the pixel electrode 36 changes while centering on the voltage $V_a$ during the selection period. Since a display state of the electrooptical material 33 is determined by the potential difference between the pixel electrode 36 and the opposing electrode 32, the display state can be changed by changing signal data supplied to the corresponding signal electrode 32, while taking $V_a$ as a reference, whereby a gray scale, for example, can be readily presented. FIGS. 2(*c*) and (*d*) show the waveforms of data signals applied to the signal electrode 32 when all pixels of one column are to be ON and when all pixels are to be OFF, respectively, and FIGS. 2(*e*) and (*f*) show the waveforms of data signals applied to the signal electrode 32 when all pixels except one pixel on the signal electrode are to be OFF and when all pixels but one are to be ON, respectively. That is, the voltage $V_{ON}$ when the pixel is to be ON or the voltage $V_{OFF}$ when the pixel is to be OFF is applied to the electrooptic material 33 during the selection period, and thus the established electric charges injected during the selection period are held during the nonselection period. In the foregoing driving method, since the data signal is independent of the characteristic of the nonlinear resistance elements 34*a* and 34*b*, even if the characteristic of elements assembled in the panel shows some variation, the driving operation can be attained without difficulty if the value of $V_{op}$ is set sufficiently large.

In the display panel including a plurality of nonlinear resistance elements in association with each pixel, the driving scheme in FIGS. 2(*a*) to 2(*f*) for an electrooptical device having a pair of nonlinear resistance elements and a pair of scan electrodes as shown in FIGS. 3(*a*) and 3(*b*) can suppress variation of an electrical resistance characteristic of the nonlinear resistance element, so that a display device having a large number of pixels and a high quality display state can be obtained.

In general, electrooptical devices are driven by a driving scheme of changing a voltage polarity in each scanning interval to prevent the application of DC voltage on the electrooptical material, for example, liquid crystal material. In the case shown in FIGS. 2(*a*) to 2(*f*), data signals applied to the signal electrodes are inverted from a first scan interval to a next scan interval in reference to the voltage $V_a$ applied to the scan electrode during the nonselection period as shown in FIGS. 2(*c*) to 2(*f*). This occurs because of the same reason stated above.

However, there are some problems in the driving scheme shown in FIGS. 2(*a*) to 2(*f*) as follows. When a scan electrode is selected lastly in the first scan interval and an ON data signal of $V_a+V_{on}$ is applied to the signal electrode, electric charges are injected to the electrooptical material 33. On the next scan interval, the voltage $V_a$ is applied to both the first and second scan electrodes and an ON data signal of $V_a+V_{on}$ is applied to the signal electrode, so that a voltage up to $2V_{on}$ is applied to at least one of the two nonlinear resistance elements after transferring to the second scan interval as shown in FIG. 2(*c*).

The voltage $2V_{on}$ lowers an electrical resistivity of the nonlinear resistance element and discharges the injected charges in the electrooptical material during the nonselection period. When a scan electrode is selected in the first scan interval before an inversion takes place and the ON data signal of $V_a+V_{on}$ is applied to the signal electrode, electric charges are injected to the electrooptical material and are held in the electrooptical material during the remaining portion of the first scan interval. When the scan interval transfers to the second scan interval, the scan electrode is selected and the charges are injected.

Consequently, an effective voltage applied to the electrooptical material 33 in the first case is higher than that of the second case. This results in a nonuniformity of display state in the display area.

Therefore, the panel screen exhibits nonuniform contrast depending on when the driving waveform is inverted.

Another embodiment of the present invention will now be described with reference to the drawings. FIG. 1 shows driving waveforms used to describe an embodiment of the present invention, specifically, FIG. 1(*a*) shows the waveform of a scanning signal applied to the first scan electrode 31*a*, FIG. 1(*b*) shows the waveform of a scanning signal applied to the second scan electrode 31*b*, and FIGS. 1(*c*), (*d*), (*e*) and (*f*) show the waveform of data signals applied to the signal electrode 32. In FIG. 1(*a*), the voltage of the first scan electrode 31*a* is kept at $V_b$ during the nonselection period as a selected voltage and rises to $V_a+V_{op}$ at the selection period in the first scan interval and to $V'_a+V_{op}$ at the next selection period in the second scan interval as a selected voltage. In FIG. 1(*b*), the voltage of the second scan electrode 31*b* is kept at $V_b$ during the nonselection period and drops to $V_a-V_{op}$ at the selection period in the first scan interval and the $V'_a-V_{op}$ at the next selection period in the second scan interval. Therefore, the voltage applied between the respective ends of the paired nonlinear resistance elements 34*a* and 34*b* becomes $2V_{op}$ at the time of selection. Accordingly, if the value of $V_{op}$ is set sufficiently large, the nonlinear resistance elements 34*a* and 34*b* become small in resistance, then, the voltage of the pixel electrode 36 immediately changes to the intermediate voltage between the voltages applied to the first and second scan electrodes respectively, such as $V_a$ in the first scan interval and $V'_a$ in the second scan interval. When a voltage corresponding to a data signal is applied to the signal electrode in reference to the above $V_a$ and $V'_a$, an applied voltage to the electrooptical material 33 disposed between the pixel electrode and the opposing signal electrode 32 can be controlled easily and stably. FIGS. 1(*c*) and (*d*) show the waveforms of data signals applied to the signal electrode 32 when all pixels connected to one column of the signal electrode are to be ON and when all pixels are to be OFF, respectively, and FIGS. 1(*e*) and (*f*) show the waveforms of data signals applied to the opposing electrode 32 when all pixels but one of one column are to be OFF and when all pixels but one are to be ON, respectively.

Therefore, at the selection period of the first scan interval, the voltages of $V_a-V_b-V_d$ and $V_a-V_b+V_d$ are applied to the electrooptical material 33 as ON and OFF voltages respectively. At the selection period of the second scan interval, the voltages of $V'_a-V_b-V_d$ and $V'_a-V_b+V_d$ are applied to the electrooptical material 33 as ON and OFF voltages, respectively. The conditions for applying equivalent ON and OFF voltages during both the first and the second scan intervals are as follows:

$$V_a-V_b-V_d=-(V'_a-V_b+V_d)$$

$$V_a-V_b+V_d=-(V'_a-V_b-V_d)$$

Therefore, the condition of the scanning signal is that the equation $V_a-V_b=-(V'_a-V_b)$ should be satisfied.

With regard to a characteristic for holding the electric charges in the electrooptical material during the nonselection period, it is evident from FIGS. 1(*c*) to 1(*f*) that the voltages applied to the signal electrodes change within a range between $V_b+V_d$ and $V_b-V_d$ throughout the scan intervals and the voltage of the scanning signal during the nonselection period is kept at $V_b$, so that the voltages applied to the nonlinear resistance elements 34*a* and 34*b* during the nonselection period ranges from $V_d$ to $-V_d$, which is too small to decrease an electrical resistivity of the nonlinear resistance elements. Accordingly, the holding characteristic is independent of when inversion takes place from the first selection period to the next selection period, whereby uniform display can be presented.

FIG. 4 is a diagram showing driving waveforms used to describe another embodiment of the present invention, specifically, FIG. 4(*a*) shows the waveform of a scanning signal applied to the first scan electrode 31*a*, FIG. 4(*b*) shows the waveform of a scanning signal applied to the second scan electrode 31*b*, and FIGS. 4(*c*), (*d*), (*e*) and (*f*) show the waveform of data signals applied to the signal electrode 32. As shown in FIGS. 4(*a*) and 4(*b*), the voltages applied to both the first and the second signal electrodes during the nonselection period are $V_b$ in the first scan interval and $V'_b$ in the second scan interval respectively. The voltages during the selection period are $V_a+V_{op}$ for the first scan electrode and $V_a-V_{op}$ for the second scan electrode respectively. Therefore the intermediate voltage between the two scan electrodes 31*a* and 31*b* during the selection period is $V_a$. FIGS. 4(*c*), (*d*), (*e*) and (*f*) show data signals applied to the signal electrode 32 when all pixels of one column are to be ON, when all pixels are to be OFF, when only one pixel is to be ON, and when only one pixel is to be OFF, respectively. Therefore, the condition of data inversion is that the following equations should hold:

$$V_a-V_b-V_d=(V_a-V'_b+V_d)$$

$$V_a-V_b+V_d=-(V_a-V'_b-V_d)$$

Therefore, the equation $V_a-V_b=-(V_a-V'_b)$ should be satisfied.

With regard to the holding characteristic, if the condition $V_a=0$ is assumed for simplicity's sake, the equation $V'_b=-V_b$ is led from the foregoing equation. In the nonselection period, an amount of discharging charges from the electrooptical material through the nonlinear resistance elements is effected by a voltage magnitude applied to the nonlinear resistance elements.

In the first case, the holding characteristic becomes worse when an inversion takes place immediately after a selection period in the first scan interval under the condition of all the ON data being applied to the signal electrode. In this case, the voltage applied to one of the nonlinear resistance elements is substantially Vb+2Vd immediately after the inversion takes place and the second scan interval begins.

In the second case, no inversion takes place in the first scan interval with transferring to the second scan interval. In this case, the voltage applied to one of the nonlinear resistance elements is Vb immediately after the selection period in the second scan interval.

Therefore, the voltage difference between the first and second cases is $2V_d$, which is substantially equal to the voltage for changing from ON data signal to OFF data signal, or reverse, applied to the signal electrode as shown in FIGS. 4(*e*) and 4(*f*). This means that a voltage variation, which is applied to the nonlinear resistance element during a nonselection period, in a scanning interval is equivalent to the voltage variation in changing from the first to the second scan intervals. Accordingly, the inventive driving method can drive the electrooptical device with uniform display state.

Although the foregoing discussion has dealt with the case where the potential of the first scan electrode 31*a* at the time of selection is always positive with respect to that of the second scan electrode 31*b*, if the intermediate potential has a voltage $V_a$, it is also applicable both to the case where the first potential is always negative and to the case where the relationship of polarity reverses each time of selection. Therefore, the foregoing effects can also be obtained in a driving method having an opposite polarity of $V_{op}$.

As described above, according to the present invention, the potential of the data signal is regulated while centering on the nonselection potential $V_b$ of the scanning signal, and the potential $V_a$ or $V_b$ is changed such that the sign of $V_a-V_b$ corresponding to the difference between the intermediate potential $V_a$ at the time of selection and the nonselection potential $V_b$ is opposed, so that the voltage applied to the electrooptic material is changed into the form of an alternating signal. Thus, the influence which data inversion imposes on the holding characteristic can be suppressed within the range of differences of the holding characteristic caused by the change of a data pattern, and uniform operation can be attained irrespective of when within each selection period inversion takes place. When actually driving the liquid crystal panel and the like, according to the conventional driving method, the effective voltage applied to each pixel unit of liquid crystal involves a deviation of up to about 0.5V depending on the timing of data inversion; but, according to the driving method of the present invention, the deviation can be suppressed to about 0.1V.

This value is substantially equal to the deviation of effective voltage caused by the display pattern. Accordingly, even upon inversion of the driving waveform, the contrast of the screen can be kept uniform and display can be presented with high picture quality.

What is claimed is:

1. A driving method for an electrooptical device having signal electrodes, first and second groups of scan electrodes, pixel electrodes, first and second groups of nonlinear resistance elements, each nonlinear resistance element in the first group of nonlinear resistance elements being connected between a respective one of the scan electrodes in the first group of scan electrodes and a respective one of the pixel electrodes, and each nonlinear resistance element in the second group of nonlinear resistance elements being connected between a respective one of the scan electrodes in the second group of scan electrodes and a respective one of the pixel electrodes, and electrooptical material interposed between the signal electrodes and the pixel electrodes, comprising the steps of: applying selected voltages which include an operation voltage value $V_{op}$ to first and second scan electrodes in the first and second groups of scan electrodes during a selection period, wherein the polarity of the value $V_{op}$ applied to the first scan electrode is opposite to the polarity of that applied to the second scan electrode; applying nonselected voltages having a smaller magnitude than the operation voltage value $V_{op}$ to both said first and second scan electrodes during a nonselection period; and applying data voltages to said signal electrodes for controlling charge injected to said electrooptical material during the selection period; wherein a center voltage level between an ON voltage level and an OFF voltage level of the data voltages is set substantially equal to a voltage level of the nonselected voltages.

2. A driving method for an electrooptical device according to claim 1; wherein a bias voltage $V_a$ is superimposed on the selected voltage in a first scan interval for applying a voltage $V_a-V_{op}$ to said first scan electrodes and a voltage $V_a+V_{op}$ to said second scan electrodes respectively during the selection period, a bias voltage $V'_a$ is superimposed on the selected voltage in a second scan interval for applying $V'_a+V_{op}$ to said first scan electrodes and a voltage $V'_a-V_{op}$ to said second scan electrodes respectively during the selection period, and a nonselected voltage $V_b$ is applied to both said first and second scan electrodes during the nonselection period, wherein a relationship among the voltage $V_a$, $V'_a$ and $V_b$ satisfies the following condition:

$$V_a-V_b=-(V'_a-V_b).$$

3. A driving method for an electrooptical device according to claim 1; wherein a bias voltage $V_a$ is superimposed on the selected voltage for applying a voltage $V_a+V_{op}$ to said first scan electrodes and $V_a-V_{op}$ to said second scan electrodes respectively during the selection period, a nonselected voltage having a voltage $V_b$ is applied to both said first and second scan electrodes during the nonselection period in a first interval, and a nonselected voltage having a voltage $V'_b$ is applied to both said first and second scan electrodes during the nonselection period in the second interval alternatively, wherein a relationship among the voltages $V_a$, $V_b$ and $V'_b$ satisfies the following condition:

$$V_a-V_b=-(V_a-V'_b).$$

4. A driving method for an electrooptical device, comprising the steps of: providing an electrooptical device comprising a plurality of pixels having a first scan electrode, a second scan electrode, a pixel electrode, a first nonlinear resistance element connected between the first scan electrode and the pixel electrode, a second nonlinear resistance element connected between the second scan electrode and the pixel electrode, the first and the second nonlinear resistance element having low resistivity when applied with a low voltage, a signal electrode and an electrooptical material disposed between the pixel electrode and the signal electrode; applying a selected voltage including an operation voltage $V_{op}$ to the first and the second scan electrodes, the operation voltage $V_{op}$ applied to the first scan electrode having a polarity opposite the operation voltage $V_{op}$ applied to the second scan electrode; applying a data voltage to the signal electrode for controlling a charge injected to the electrooptical material during the selection period; and applying a nonselected voltage having a smaller magnitude than the operation voltage to the first and the second scan electrodes during a nonselection period effective to hold the charge injected to the electrooptical material; wherein the step of applying a selected voltage comprises superimposing a bias voltage $V_a$ on the selected voltage during a first scan interval effective to apply a voltage $V_a+V_{op}$ to the first scan electrode and a voltage $V_a-V_{op}$ to the second scan electrode, and superimposing a bias voltage $V'_a$ on the selected voltage during a second scan interval effective to apply a voltage $V'_a+V_{op}$ to the first scan electrode and a voltage $V'_a-V_{op}$ to the second scan electrode; and the step of applying a nonselected voltage comprises applying a nonselected voltage $V_b$ to both the first and second scan electrodes and a relationship among the voltages $V_a$, $V'_a$ and $V_b$ satisfies the condition:

$$V_a-V_b=-(V'_a-V_b).$$

5. A driving method for an electrooptical device, comprising the steps of: providing an electrooptical device comprising a plurality of pixels having a first scan electrode, a second scan electrode, a pixel electrode, a first nonlinear resistance element connected between the first scan electrode and the pixel electrode, a second nonlinear resistance element connected between the second scan electrode and the pixel electrode, the first and the second nonlinear resistance element having low resistivity when applied with a low voltage, a signal electrode and an electrooptical material disposed between the pixel electrode and the signal electrode; applying a selected voltage including an operation voltage $V_{op}$ to the first and the second scan electrodes, the operation voltage $V_{op}$ applied to the first scan electrode having a polarity opposite the operation voltage $V_{op}$ applied to the second scan electrode; applying a data voltage to the signal electrode for controlling a charge injected to the electrooptical material during the selection period; and applying a nonselected voltage having a smaller magnitude than the operation voltage to the first and the second scan electrodes during a nonselection period effective to hold the charge injected to the electrooptical material; wherein the step of applying a selected voltage comprises superimposing a bias voltage $V_a$ on the selected voltage effective to apply a voltage $V_a+V_{op}$ to the first scan electrode and a voltage $V_a-V_{op}$ to the second scan electrode; and the step of applying a nonselected voltage comprises applying a nonselected voltage $V_b$ to both the first and the second scan electrode during a first scan interval, and applying a nonselected voltage $V'_b$ to both the first and the second scan electrode during a second scan interval wherein a relationship among the voltages $V_a$, $V_b$ and $V'_b$ satisfies the condition:

$$V_a-V_b=-(V_a-V'_b).$$

6. A driving method for an electrooptical device, comprising the steps of: providing an electrooptical device comprising a first group of scan electrodes, a second group of scan electrodes, pixel electrodes, a first group of nonlinear resistance elements each connected between a respective first scan electrode and a respective pixel electrode, a second group of nonlinear resistance elements each connected between a respective second scan electrode and the respective pixel electrode, the first and second nonlinear resistance elements having low resistivity when applied with a high voltage and high resistivity when applied with a low voltage, signal electrodes and an electrooptical material disposed between the pixel electrodes and the signal electrodes; applying selected voltages including an operation voltage $V_{op}$ to the first and second groups of scan electrodes, the operation voltage $V_{op}$ applied to the first scan electrodes having a polarity opposite the operation voltage $V_{op}$ applied to the second scan electrodes; applying data voltages to the signal electrodes for controlling a charge injected to the electrooptical material during the selection period; and applying nonselected voltages to the first and the second scan electrodes during a nonselection period and having a magnitude less than a magnitude of the operation voltage $V_{op}$ and being effective to not decrease the electrical resistivity of the first and the second nonlinear elements, the magnitude of the nonselected voltages during a scan interval being set in a range between the smallest and largest levels of the data voltages.

7. A driving method for an electrooptical device according to claim 6; wherein the step of applying selected voltages comprises superimposing a bias voltage $V_a$ on the selected voltages during a first scan interval effective to apply a voltage $V_a+V_{op}$ to the first scan electrodes and a voltage $V_a-V_{op}$ to the second scan electrodes, and superimposing a bias voltage $V'_a$ on the selected voltages during a second scan interval effective to apply a voltage $V'_a+V_{op}$ to the first scan electrodes and a voltage $V'_a-V_{op}$ to the second scan electrodes; and the step of applying nonselected voltages comprises applying nonselected voltages $V_b$ to both the first and second scan electrodes and a relationship among the voltages $V_a$, $V'_a$ and $V_b$ satisfies the condition:

$$V_a-V_b=-(V'_a-V_b).$$

8. A driving method for an electrooptical device according to claim 6; wherein the step of applying selected voltages comprises superimposing a bias voltage $V_a$ on the selected voltages effective to apply a voltage $V_a+V_{op}$ to the first scan electrodes and a voltage $V_a-V_{op}$ to the second scan electrodes; and the step of applying nonselected voltages comprises applying nonselected voltages $V_b$ to both the first and the second scan electrodes during a first scan interval, and applying nonselected voltages $V'_b$ to both the first and the second scan electrodes during a second scan interval wherein a relationship among the voltages $V_a$, $V_b$ and $V'_b$ satisfies the condition:

$$V_a-V_b=-(V_a-V'_b).$$

* * * * *